US009122208B2

(12) United States Patent
Shibuya

(10) Patent No.: US 9,122,208 B2
(45) Date of Patent: Sep. 1, 2015

(54) BELT CLEANING DEVICE AND IMAGE FORMING APPARATUS WITH SAME

(71) Applicant: KYOCERA Document Solutions Inc., Osaka-shi, Osaka (JP)

(72) Inventor: Teppei Shibuya, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/445,543

(22) Filed: Jul. 29, 2014

(65) Prior Publication Data

US 2015/0037062 A1 Feb. 5, 2015

(30) Foreign Application Priority Data

Jul. 31, 2013 (JP) ..... 2013-158384

(51) Int. Cl.
*G03G 15/16* (2006.01)
*G03G 21/00* (2006.01)

(52) U.S. Cl.
CPC ..... *G03G 15/161* (2013.01); *G03G 21/0035* (2013.01)

(58) Field of Classification Search
CPC ..... G03G 15/161; G03G 21/0035
See application file for complete search history.

(56) References Cited

U.S. PATENT DOCUMENTS 4,361,922 A * 12/1982 Karal ..... 15/1.51
6,980,765 B2 * 12/2005 McStravick et al. ..... 399/354
7,929,896 B2 * 4/2011 Matayoshi et al. ..... 399/343

FOREIGN PATENT DOCUMENTS

JP 04-270371 9/1992
JP 2007025163 2/2007
JP 2009-014944 1/2009
JP 2009230083 10/2009

* cited by examiner

*Primary Examiner* — Gregory H Curran
(74) *Attorney, Agent, or Firm* — Gerald E. Hespos; Michael J. Porco; Matthew T. Hespos

(57) ABSTRACT

A belt cleaning device is a device for an endless belt which has a bearing surface for bearing a toner image, and includes a cleaning unit and a toner rubbing portion. The cleaning unit is arranged to face the bearing surface and removes residual toner remaining on the bearing surface. The toner rubbing portion is arranged to face the bearing surface at a side upstream of the cleaning unit in a rotating direction of the belt and charges the residual toner by rubbing the residual toner. The toner rubbing portion includes brush bristles whose tips are faced toward the bearing surface and which are charged when rubbing the residual toner. The brush bristles include first bristle-like bodies to be positively charged and second bristle-like bodies to be negatively charged. The first and second bristle-like bodies are alternately arranged in a predetermined first direction.

9 Claims, 13 Drawing Sheets

BELT CLEANING DEVICE AND IMAGE FORMING APPARATUS WITH SAME

This application is based on Japanese Patent Application No. 2013-158384 filed with the Japan Patent Office on Jul. 31, 2013, the contents of which are hereby incorporated by reference.

BACKGROUND

The present disclosure relates to a belt cleaning device and an image forming apparatus with the same.

Conventionally, there have been known image forming apparatuses such as printers employing a tandem developing method in which a toner image of each color is secondarily transferred to a sheet after being primarily transferred onto an intermediate transfer belt. In the tandem developing method, residual toner not transferred to a sheet tends to remain on the belt. Thus, a cleaning unit provided with a fur brush for removing residual toner from the belt is provided on a downstream side in a rotating direction of the belt in some cases. The cleaning unit electrostatically removes toner by applying a bias having a polarity opposite to a charging polarity of the toner to the fur brush (bias cleaning method). However, the residual toner tends to have a polarity opposite to that of the toner at the time of development, i.e. have the same polarity as the fur brush, wherefore it is difficult to electrostatically remove the residual toner. Accordingly, it has been proposed to dispose a bar brush for charging residual toner on a side of the belt upstream of the fur brush.

Recently, inexpensive paper and low-quality paper such as recycled paper have been frequently used as sheets for cost reduction and reutilization of resources. Talc and calcium carbonate are blended in large quantity as a surface treatment agent and a filler in such low-quality paper. Thus, paper powder containing these foreign substances adheres to the bar brush as image formation is repeated.

FIG. 17 is a diagram showing brush bristles 40 of a bar brush 33 in a clean state where no foreign substance adheres to the tips. FIG. 18 is a diagram showing the brush bristles 40 of the bar brush 33 in a state where hardened paper powder adheres to the tips. In a state shown in FIGS. 17 and 18, the tips of the brush bristles 40 are facing toward a front side of the planes of FIGS. 17 and 18. Small and large pieces of paper powder Pa adhere to the tips of the brush bristles 40 shown in FIG. 18. With the brush bristles 40 having the paper powder Pa adhering thereto as shown in FIG. 18, a frictional charging effect for residual toner is reduced and a belt cleaning failure occurs. Further, the paper powder adhering to the brush bristles 40 of the bar brush 33 is hardened and scrapes a belt surface to reduce secondary transferability. As a result, in a conventional image forming apparatus, the quality of an image transferred to a sheet is reduced and it is not possible to obtain images with good quality over a long period of time.

Accordingly, a first method has been proposed in which foreign substances are attracted and collected by insulating threads charged to have a polarity opposite to that of foreign substances. Further, a second method has been proposed in which foreign substances are collected by applying positive and negative biases respectively to two fur brushes.

SUMMARY

A belt cleaning device according to one aspect of the present disclosure is a cleaning device for an endless belt which has a bearing surface for bearing a toner image and is rotated in a predetermined direction. The belt cleaning device includes a cleaning unit and a toner rubbing portion. The cleaning unit is arranged to face the bearing surface and removes residual toner remaining on the bearing surface. The toner rubbing portion is arranged to face the bearing surface at a side upstream of the cleaning unit in the rotating direction of the belt and charges the residual toner by rubbing the residual toner.

The toner rubbing portion includes brush bristles whose tips are faced toward the bearing surface and which are charged when rubbing the residual toner. The brush bristles include first bristle-like bodies to be positively charged and second bristle-like bodies to be negatively charged. The first and second bristle-like bodies are alternately arranged in a predetermined first direction.

These and other objects, features and advantages of the present disclosure will become more apparent upon reading the following detailed description along with the accompanying drawings.

DETAILED DESCRIPTION

First Embodiment

Image Forming Apparatus

Hereinafter, one embodiment of an image forming apparatus including a belt cleaning device of the present disclosure is described in detail based on the drawings. In this embodiment, a tandem color printer in which a plurality of image forming units corresponding to a plurality of toner colors are arranged is illustrated as an example of the image forming apparatus. The image forming apparatus may be, for example, a copier, a facsimile machine or a complex machine of these.

Figure 1:
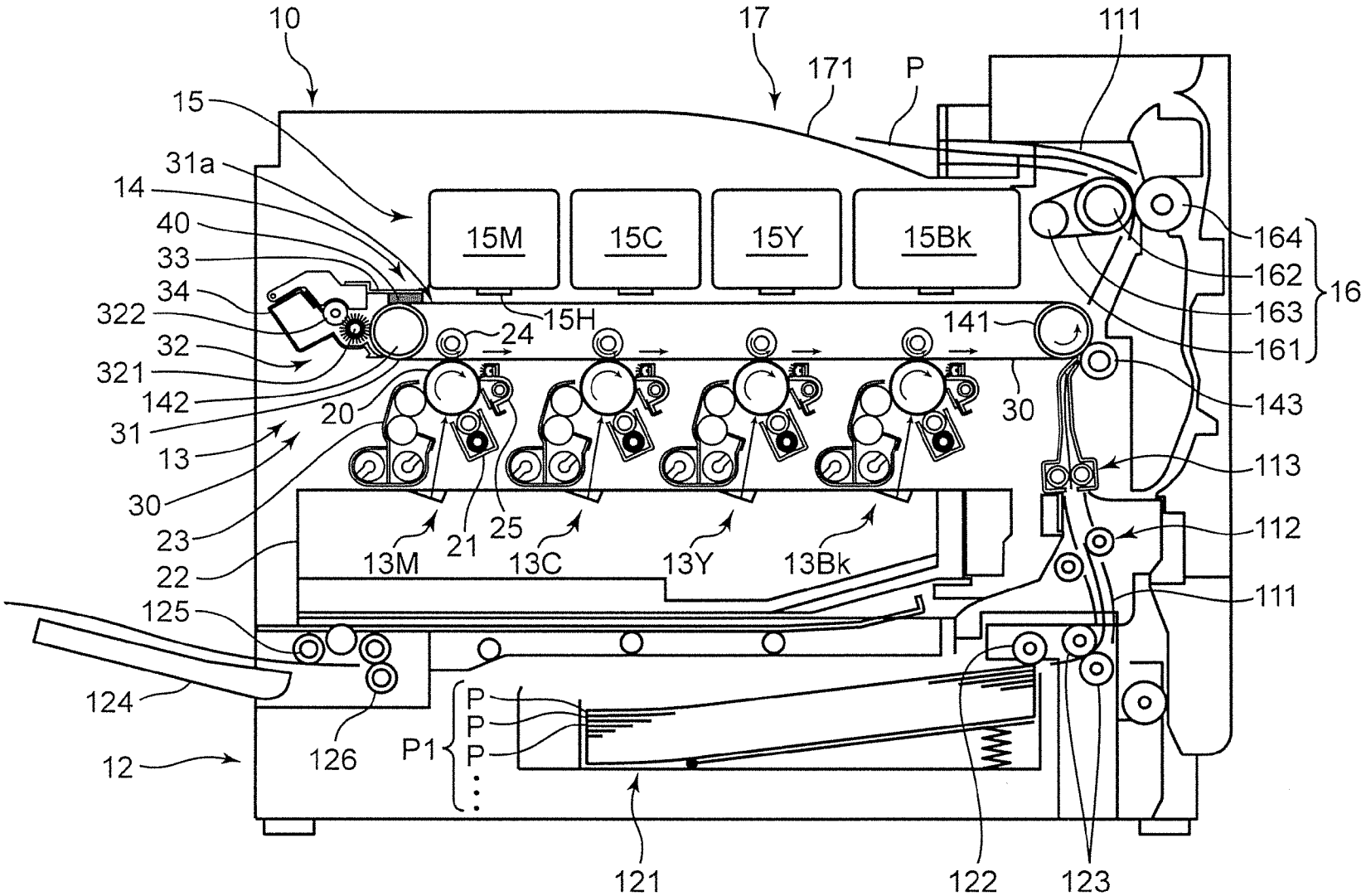
FIG. 1 is a sectional view showing an internal structure of an image forming apparatus according to one embodiment of the present disclosure.

FIG. 1 is a sectional view showing an internal structure of an image forming apparatus 10. This image forming apparatus 10 includes an apparatus main body 11 having a box-shaped housing structure. A sheet feeding unit 12 for feeding sheets P, an image forming station 13 for forming toner images to be transferred to a sheet P fed from the sheet feeding unit 12, an intermediate transfer unit 14 to which toner images are primarily transferred, a toner supply unit 15 for supplying toner to the image forming station 13 and a fixing unit 16 for fixing an unfixed toner image formed on a sheet P to the sheet P are housed in this apparatus main body 11. Further, a sheet discharge portion 17 to which a sheet P subjected to a fixing process in the fixing unit 16 is discharged is provided on the top of the apparatus main body 11.

A vertically extending sheet conveyance path 111 is formed in the apparatus main body 11. A pair of conveyor rollers 112 for conveying a sheet are disposed at a suitable position of the sheet conveyance path 111. Further, a pair of registration rollers 113 for correcting the skew of a sheet and feeding the sheet to a secondary transfer nip portion to be described later at a predetermined timing are disposed upstream of the nip portion in the sheet conveyance path 111. The sheet conveyance path 111 is a conveyance path for conveying the sheet P from the sheet feeding unit 12 to the sheet discharge portion 17 by way of the image forming station 13 and the fixing unit 16.

The sheet feeding unit 12 includes a sheet tray 121, a pickup roller 122 and a pair of feed rollers 123. The sheet tray 121 is detachably mounted at a lower position of the apparatus main body 11 and stores a sheet stack P1 in which a plurality of sheets P are stacked. The pickup roller 122 picks up the uppermost sheet P of the sheet stack P1 stored in the sheet tray 121 one by one. The pair of feed rollers 123 feeds the sheet P picked up by the pickup roller 122 to the sheet conveyance path 111.

The sheet feeding unit 12 includes a manual sheet feeder attached to a side surface of the apparatus main body 11. The manual sheet feeder includes a manual feed tray 124, a pickup roller 125 and a pair of feed rollers 126. The manual feed tray 124 is a tray on which a sheet P to be manually fed is to be placed. The pickup roller 125 picks up the sheet P placed on the manual feed tray 124. The pair of feed rollers 126 feeds the sheet P picked up by the pickup roller 125 to the sheet conveyance path 111.

The image forming station 13 is for forming toner images to be transferred to a sheet P and includes a plurality of image forming units for forming toner images of different colors. A magenta unit 13M using a developer of magenta (M), a cyan unit 13C using a developer of cyan (C), a yellow unit 13Y using a developer of yellow (Y) and a black unit 13Bk using a developer of black (Bk) successively arranged from an upstream side to a downstream side in a rotating direction of an intermediate transfer belt 31 to be described later are provided as the image forming units in this embodiment. Each of the units 13M, 13C, 13Y and 13Bk includes a photoconductive drum 20 and a charging device 21, a developing device 23, a primary transfer roller 24 and a cleaning device 25 arranged around the photoconductive drum 20. Further, an exposure device 22 common to the respective units 13M, 13C, 13Y and 13Bk is arranged below the image forming units.

The photoconductive drum 20 is driven and rotated about its shaft and an electrostatic latent image and a toner image are formed on the circumferential surface thereof. A photoconductive drum using an amorphous silicon (a-Si) based material can be used as the photoconductive drum 20. The charging device 21 is for uniformly charging the surface of the photoconductive drum 20. The exposure device 22 includes various optical devices such as a laser light source, a polygon mirror and deflecting mirrors and irradiates the uniformly charged circumferential surface of the photoconductive drum 20 with light modulated based on image data to form an electrostatic latent image.

The developing device 23 supplies toner to the circumferential surface of the photoconductive drum 20 to develop an electrostatic latent image formed on the photoconductive drum 20. The developing device 23 is for a two-component developer composed of toner and carrier and includes an agitating roller, a magnetic roller and a developing roller. The agitating roller charges the toner by conveying the two-component developer in a circulating manner while agitating it. A two-component developer layer is carried on the circumferential surface of the magnetic roller. A toner layer is carried on the circumferential surface of the developing roller. The toner on the developing roller is supplied to the circumferential surface of the photoconductive drum 20 to develop an electrostatic latent image.

The primary transfer roller 24 forms a nip portion together with the photoconductive drum 20 while sandwiching the intermediate transfer belt 31 to be described later, and primarily transfers a toner image on the photoconductive drum 20 to the intermediate transfer belt 31. The cleaning device 25 cleans the circumferential surface of the photoconductive drum 20 after the transfer of a toner image.

The intermediate transfer unit 14 is arranged in a space provided between the image forming station 13 and the toner supply unit 15 and includes a drive roller 141 and a driven roller 142 rotatably supported in a unit frame (not shown) and the intermediate transfer belt 31. The intermediate transfer belt 31 is an endless belt-like rotary body and has a circumferential surface (bearing surface) for bearing toner images transferred from the respective image forming units. The intermediate transfer belt 31 is so mounted on the drive roller 141 and the driven roller 142 that the circumferential surface thereof is in contact with the circumferential surfaces of the respective photoconductive drums 20. A rotational drive force is applied to the drive roller 141 and the intermediate transfer belt 31 is driven and rotated in a predetermined direction by the rotation of the drive roller 141.

A belt cleaning device 30 for removing the toner (residual toner) remaining on the circumferential surface of the intermediate transfer belt 31 is arranged near the driven roller 142. The belt cleaning device 30 is described in detail later.

A secondary transfer roller 143 is arranged to face the drive roller 141. The secondary transfer roller 143 is pressed into contact with the circumferential surface of the intermediate transfer belt 31 to form a secondary transfer nip portion. Toner images primarily transferred to the intermediate transfer belt 31 are secondarily transferred to a sheet P supplied from the sheet feeding unit 12 at the secondary transfer nip portion.

The toner supply unit 15 includes a magenta toner container 15M, a cyan toner container 15C, a yellow toner container 15Y and a black toner container 15Bk. These toner containers 15M, 15C, 15Y and 15Bk are for storing toner of MCYBk colors to be supplied and supply the toner of each color to the developing devices 23 of the image forming units 13M, 13C, 13Y and 13Bk corresponding to the respective MCYBk colors through toner discharge openings 15H formed on the bottom surfaces of the containers via toner conveying units (not shown).

The fixing unit 16 includes a heating roller 161 internally provided with a heating source, a fixing roller 162 arranged to face the heating roller 161, a fixing belt 163 mounted on the fixing roller 162 and the heating roller 161 and a pressure roller 164 arranged to face the fixing roller 162 via the fixing belt 163 and form a fixing nip portion. A sheet P supplied to the fixing unit 16 is heated and pressed by passing through the fixing nip portion. In this way, a toner image transferred to the sheet P at the secondary transfer nip portion is fixed to the sheet P.

The sheet discharge portion 17 includes a sheet discharge tray 171 for receiving a sheet P. The sheet P subjected to the fixing process is discharged toward the sheet discharge tray 171 by way of the sheet conveyance path 111 extending from an upper part of the fixing unit 16.

<Belt Cleaning Device>

Figure 2:
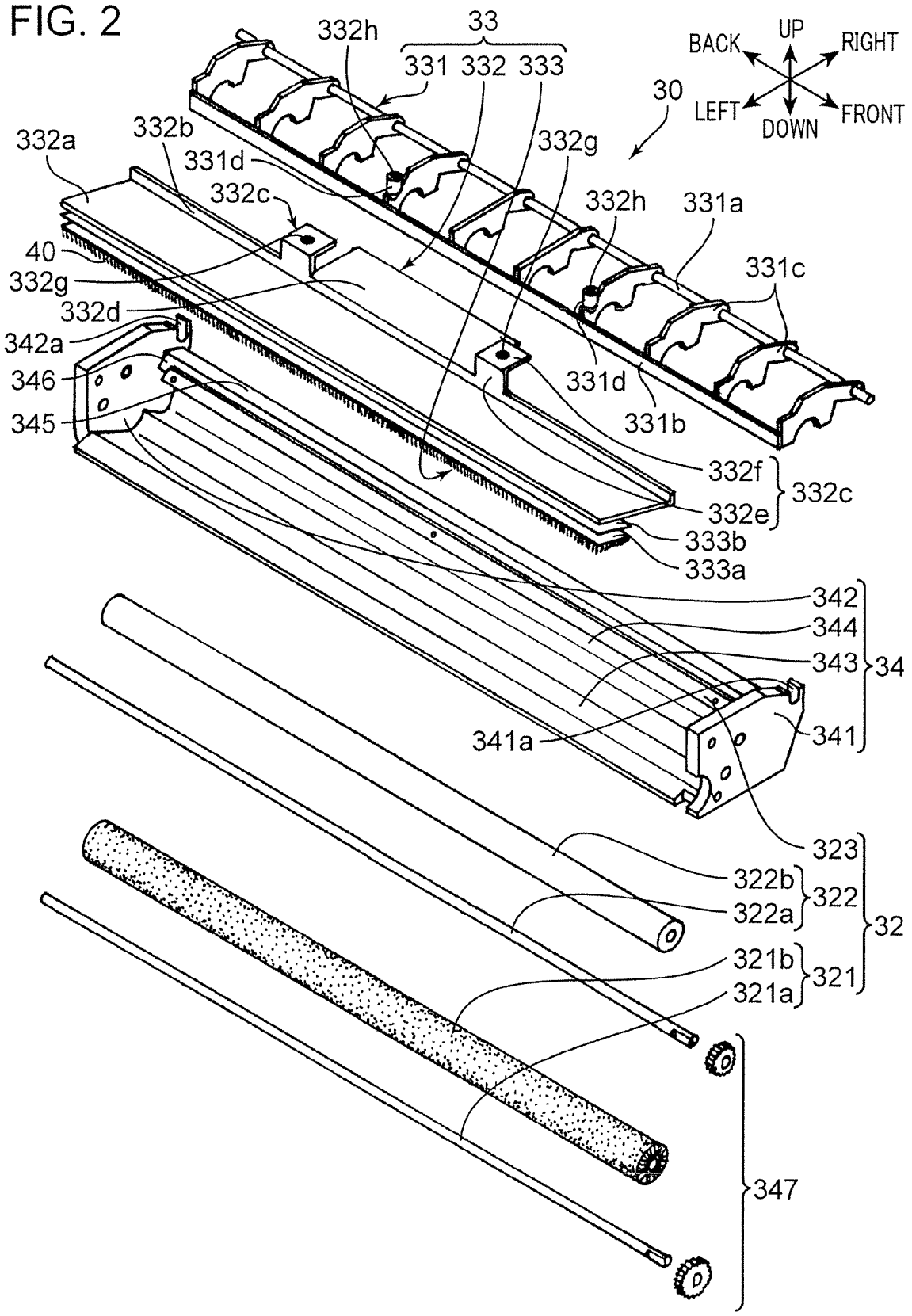
FIG. 2 is an exploded perspective view of a belt cleaning device according to the embodiment of the present disclosure.
Figure 3:
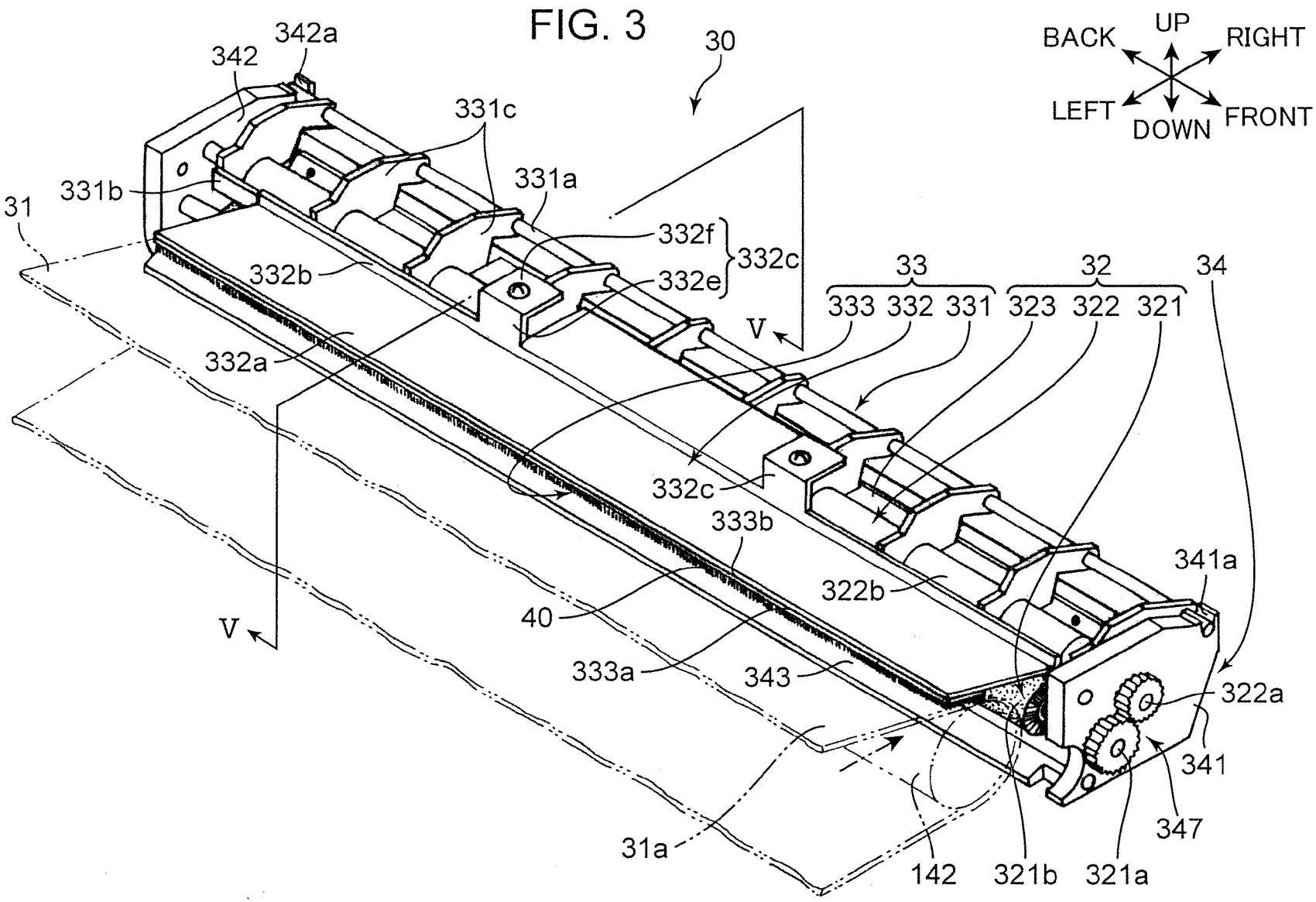
FIG. 3 is a perspective view of the belt cleaning device.
Figure 4:
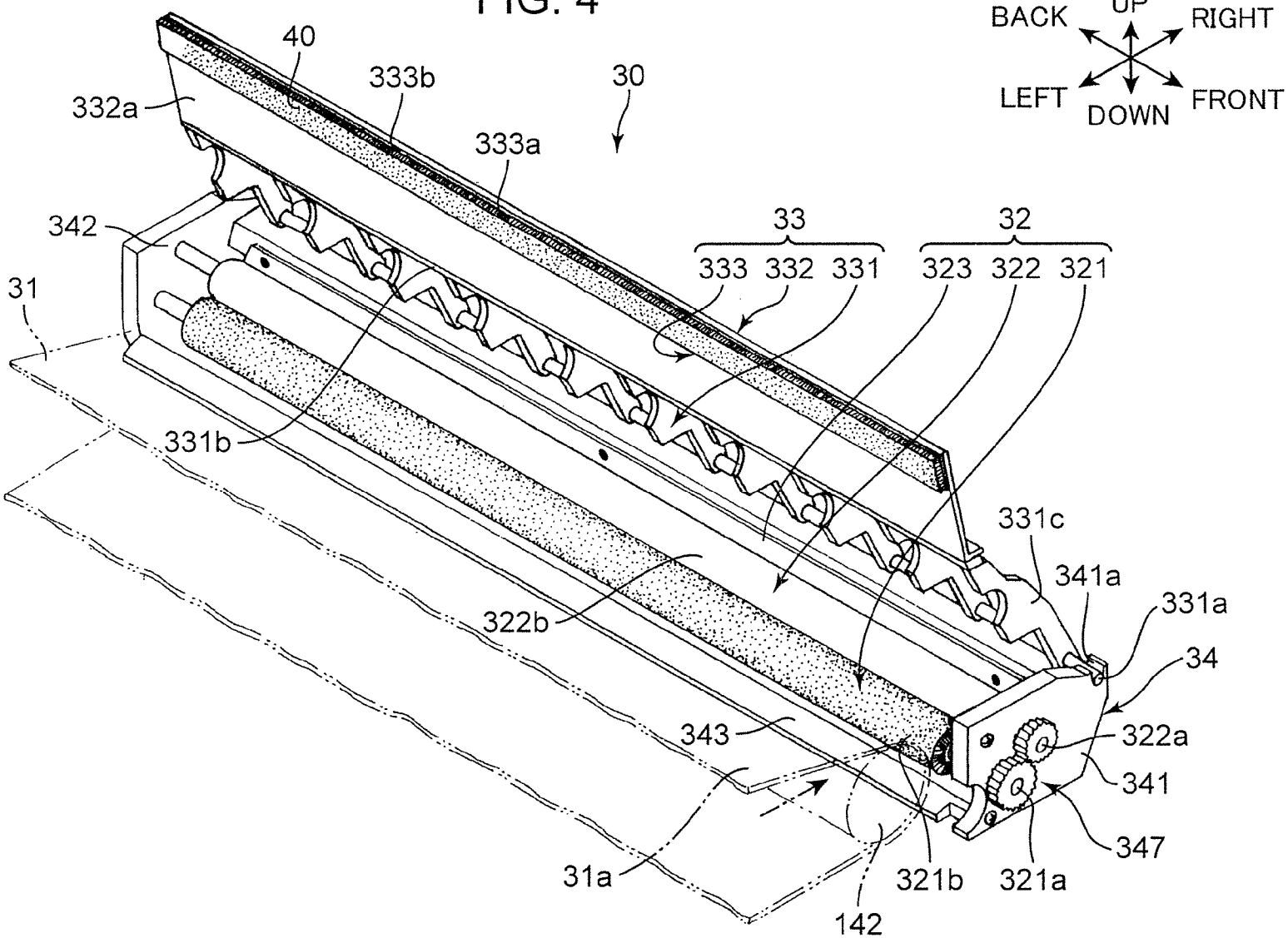
FIG. 4 is a perspective view of the belt cleaning device.
Figure 5:
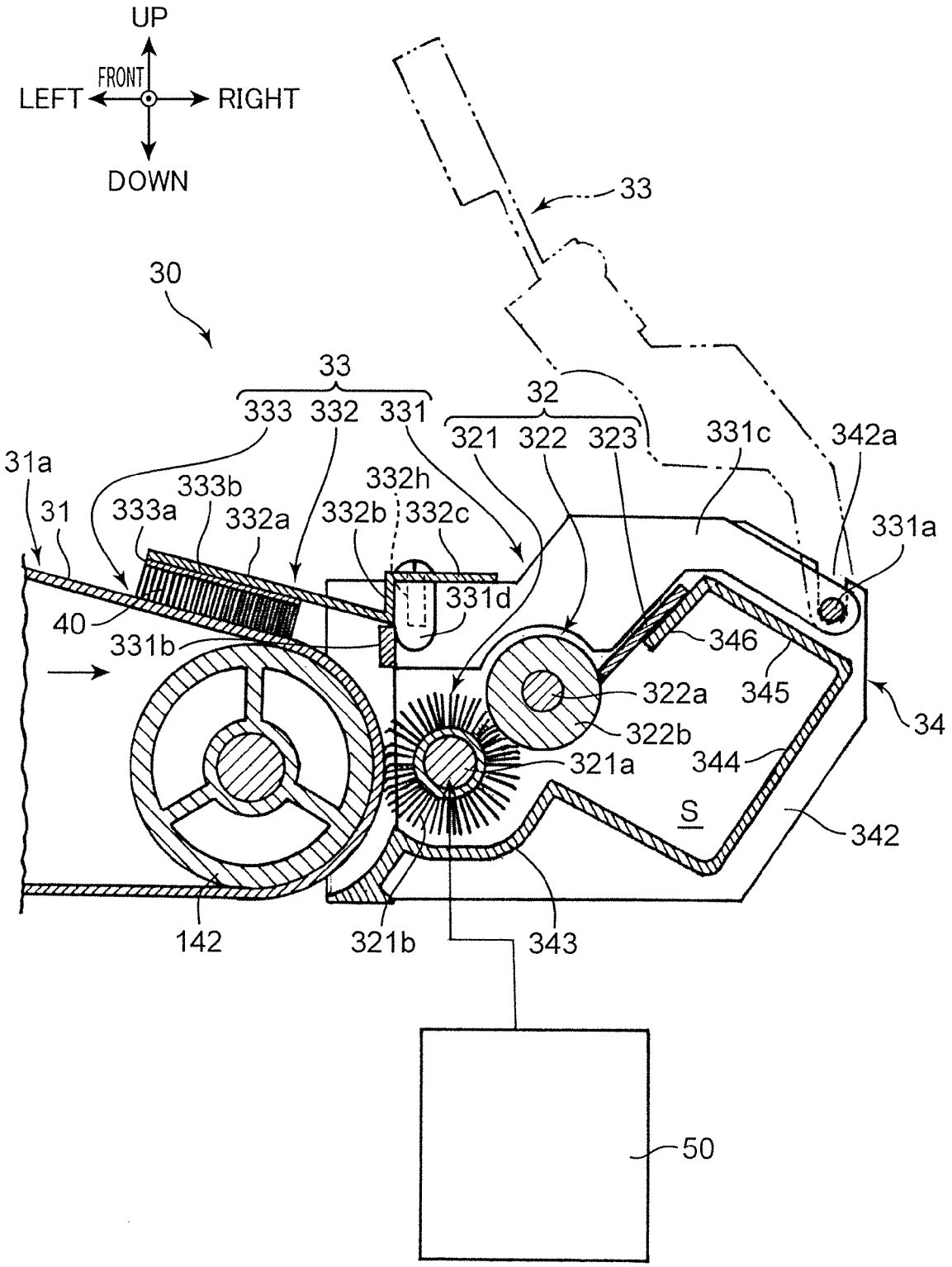
FIG. 5 is a sectional view taken along line V-V of FIG. 3.

Next, the belt cleaning device 30 provided in the above image forming apparatus 10 is described in detail. FIG. 2 is an exploded perspective view of the belt cleaning device 30, and FIGS. 3 and 4 are perspective views of the belt cleaning device 30 in an assembled state. FIG. 3 shows a state where a bar brush 33 is set in a closed posture and FIG. 4 shows a state where the bar brush 33 is set in an open state. FIG. 5 is a sectional view of the belt cleaning device 30 shown in FIG. 3 taken along line V-V. Note that the intermediate transfer belt 31 is not shown in FIG. 2 and is shown in chain double-dashed line in FIGS. 3 and 4 to clarify description.

The intermediate transfer belt 31 (endless belt) has a bearing surface 31*a* for bearing toner images and is rotated in a predetermined direction. The belt cleaning device 30 mainly includes a cleaning unit 32 arranged to face the bearing surface 31*a* and configured to remove residual toner remaining on the bearing surface 31*a* and the bar brush 33 (toner rubbing portion) arranged to face the bearing surface 31*a* at a side upstream of the cleaning unit 32 in the rotating direction of the intermediate transfer belt 31 and configured to charge the residual toner by rubbing it. Further, the belt cleaning device 30 includes a casing 34 which is open at a position facing the driven roller 142. The casing 34 is mounted in a unit frame (not shown) of the intermediate transfer unit 14 and integrally formed with a storage space S in which the residual toner collected from the intermediate transfer belt 31 by the cleaning unit 32 is stored. Each component is described below.

The casing 34 includes a front plate 341, a rear plate 342 arranged to face the front plate 341 on a rear side, a bottom plate 343 extending between lower edge parts of the front and rear plates 341, 342, a right plate 344 extending between right edge parts of the front and rear plates 341, 342 and a ceiling plate 345 and is open leftward. The casing 34 is fixed to the unit frame by screwing.

The intermediate transfer belt 31 is an endless belt body and so mounted on the drive roller 141 and the driven roller 142 (see FIG. 1) that the bearing surface 31*a* (outer circumferential surface) thereof is in contact with the circumferential surface of each photoconductive drum. Toner images formed on the bearing surface 31*a* are secondarily transferred to a sheet supplied from the sheet feeding unit at the secondary transfer nip portion. At this time, part of the toner forming the toner images on the bearing surface 31*a* remains as residual toner on the bearing surface 31*a* of the intermediate transfer belt 31. Generally, since toner images are transferred to an intermediate transfer belt from a plurality of image forming units in a tandem color printer, a lot of residual toner tends to be left. However, since the belt cleaning device 30 of this embodiment includes the bar brush 33 to be described later, the residual toner can be satisfactorily frictionally charged and satisfactorily removed in the cleaning unit 32 even if a lot of residual toner is left on the intermediate transfer belt 31.

The cleaning unit 32 includes a fur brush 321 whose circumferential surface is held in contact with the bearing surface 31*a* of the intermediate transfer belt 31, a collecting roller 322 whose circumferential surface is held in contact with the circumferential surface of the fur brush 321 and a blade 323 which scrapes off the residual toner collected on the circumferential surface of the collecting roller 322. The scraped-off residual toner is stored in the storage space S.

The fur brush 321 includes a brush shaft 321*a* and a fur brush main body 321*b* integrally formed to the brush shaft 321*a*. The fur brush main body 321*b* includes a tube body made of synthetic resin and brush bristles planted on the circumferential surface of the tubular body. The brush shaft 321*a* is long in a front-back direction and connected to a motor (not shown). The fur brush main body 321*b* is long in the front-back direction and has a length comparable to a width of the intermediate transfer belt 31. The fur brush 321 is positioned in the casing 34 by inserting the brush shaft 321*a* into through holes formed on the front and rear plates 341, 342.

The brush bristles of the fur brush main body 321*b* touch the surface of the intermediate transfer belt 31. A negative bias voltage is applied to the fur brush main body 321*b* by a power supply device 50 (see FIG. 5). Thus, the residual toner positively charged on the intermediate transfer belt 31 is electrostatically attracted to the fur brush main body 321*b*.

The collecting roller 322 includes a collecting roller shaft 322*a* and a collecting roller main body 322*b* integrally formed to the collecting roller shaft 322*a*. The collecting roller main body 322*b* is made of elastomer such as rubber or soft synthetic resin. Further, the collecting roller main body 322*b* is long in the front-back direction and has a length comparable to that of the fur brush main body 321*b*. The collecting roller 322 is positioned in the casing 34 by inserting the collecting roller shaft 322*a* into through holes formed on the front and rear plates 341, 342. The circumferential surface of the collecting roller 322 touches the brush bristles of the fur brush main body 321*b* in a positioned state.

A pair of gear mechanisms 347 for connecting the brush shaft 321*a* and the collecting roller shaft 322*a* are provided on a front side surface of the front plate 341. When the brush shaft 321*a* is rotated by a drive force from the motor, a rotational drive force is transmitted to the collecting roller shaft 322*a*, which is then rotated in a direction opposite to the brush shaft 321*a*. In this way, the fur brush 321 and the collecting roller 322 are respectively rotated in opposite directions.

The blade 323 is provided to scrape off the residual toner transferred from the brush bristles of the fur brush 321 to the circumferential surface of the collecting roller 322. One end of the blade 323 is fixed to an inclined plate 346 extending toward a left lower side from a left edge part of the ceiling plate 345 of the casing 34, and the other end thereof is held in contact with the circumferential surface of the collecting roller main body 322*b*. By the counterclockwise rotation of the collecting roller 322, the residual toner adhering to the circumferential surface of the collecting roller main body 322*b* is scraped off by the blade 323 and collected into the storage space S of the casing 34.

The bar brush 33 is arranged to face the bearing surface 31*a* at the side upstream of the cleaning unit 32 in the rotating direction of the intermediate transfer belt 31. The bar brush 33 is long in the front-back direction and has a length in the front-back direction comparable to the width of the intermediate transfer belt 31. The bar brush 33 includes a ladder-like frame 331 rotatably mounted on the upper surface of the casing 34, a supporting tool 332 fixed to the ladder-like frame 331 and a brush main body 333 attached to the supporting tool 332.

A toner image formed on the surface of the intermediate transfer belt 31 is normally charged from +20 to +30 μC/g. However, the toner image on the intermediate transfer belt 31 receives electric charges having an opposite polarity from the secondary transfer roller 143 when facing the secondary transfer roller 143 (see FIG. 1). As a result, the residual toner remaining on the intermediate transfer belt 31 after passing the secondary transfer roller 143 tends to have a polarity opposite to that at the time of development or no polarity. Thus, the residual toner is unlikely to be attracted to the fur brush 321 to which the negative bias current is applied.

Accordingly, the bar brush 33 rubs the residual toner on the side upstream of the cleaning unit 32 in the rotating direction of the intermediate transfer belt 31 so that the residual toner is electrostatically attracted to the fur brush 321. By this rubbing, the polarity of the residual toner changes to the original charge polarity (positive).

The ladder-like frame 331 includes a cylindrical frame 331*a* extending in the front-back direction, a rectangular frame 331*b* arranged to face the cylindrical frame 331*a* and extending in the front-back direction, and a plurality of plates 331*c* mounted at predetermined intervals between the cylindrical frame 331*a* and the rectangular frame 331*b*. The number of the plates 331*c* is not particularly limited. In this embodiment, the ladder-like frame 331 is illustrated in which ten plates 331*c* are mounted. Fitting grooves 341*a*, 342*a* into which opposite end parts of the cylindrical frame 331*a* are to be fitted are provided on the front and rear plates 341, 342. The ladder-like frame 331 can rotate about the cylindrical frame 331*a* by fitting the opposite end parts of the cylindrical frame 331*a* into the fitting grooves 341*a*, 342*a*.

The supporting tool 332 includes a supporting plate 332*a* long in the front-back direction, a bent portion 332*b* formed by bending a right edge part of the supporting plate 332 upwardly, a pair of brackets 332*c* projecting upwardly from the bent portion 332*b* and an extending plate 332*d* extending rightwardly from the bent portion 332*b* between the pair of brackets 332*c*. The bracket 332*c* is composed of a projecting piece 332*e* projecting upwardly from the bent portion 332*b* and a bent piece 332*f* bent rightwardly from the tip edge of the projecting piece 332*e*. On the other hand, the ladder-like frame 331 includes a pair of cylindrical bodies 331*d* projecting upwardly from left end positions of the fourth plates 331*c* from the front and rear ends. Screw holes 332*h* corresponding to through holes 332*g* of the brackets 332*c* are provided on the upper surfaces of the pair of cylindrical bodies 331*d*. The supporting tool 332 is attached to the ladder-like frame 331 by inserting predetermined screws into the through holes 332*g* and tightening them into the screw holes 332*h* (see FIG. 5).

A length of the brush main body 333 in the front-back direction is substantially equal to that of the supporting plate 332*a* and includes a base sheet 333*a* made of synthetic resin and a multitude of brush bristles 40 planted on the lower surface of the base sheet 333*a*. A length of the base sheet 333*a* in the front-back direction is substantially equal to that of the supporting plate 332*a*, and a length thereof in a lateral direction is substantially half that of the supporting plate 332*a*. The brush main body 333 is attached to a left half of the lower surface of the supporting plate 332*a* via a double-faced adhesive tape 333*b* having adhesive layers formed on both sides.

Figure 6:
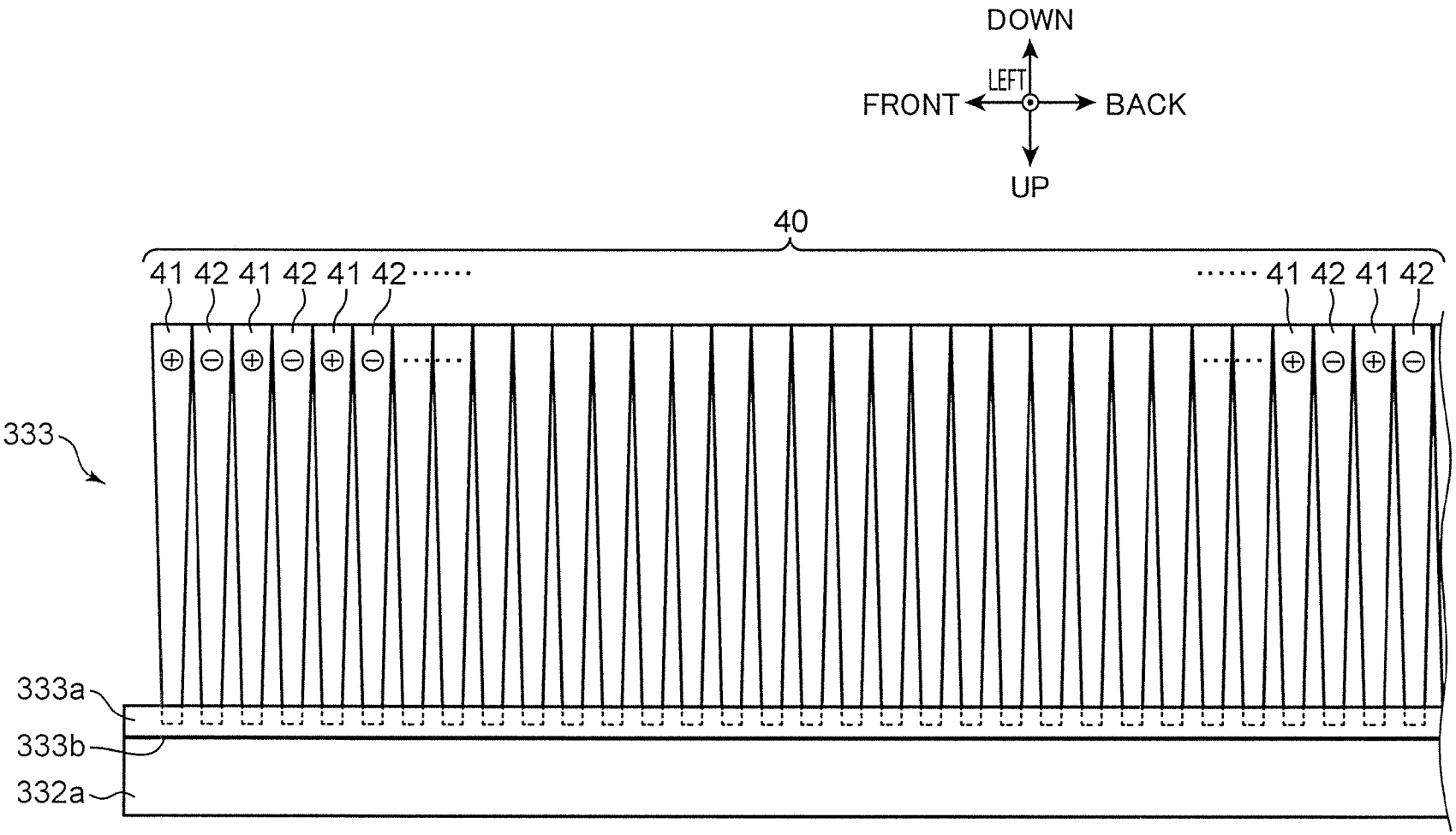
FIG. 6 is a diagram showing brush bristles according to the embodiment of the present disclosure when viewed from left.
Figure 7:
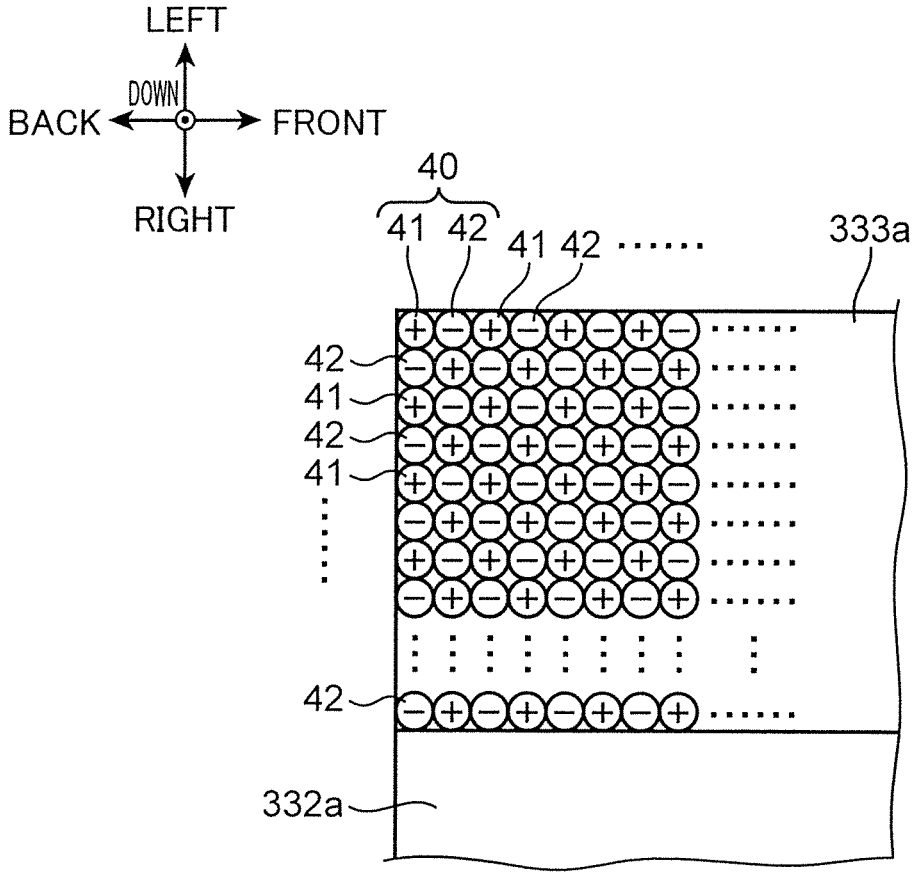
FIG. 7 is a diagram showing the arrangement of the brush bristles.

With reference to FIGS. 6 and 7, the brush bristles 40 are described in detail. FIGS. 6 and 7 are diagrams showing the arrangement of the brush bristles 40 planted on the base sheet 333*a*. FIG. 6 is the diagram of the brush bristles 40 when viewed from left and FIG. 7 is the diagram of the tips of the brush bristles 40 when viewed from below. In this embodiment, the brush bristle 40 includes one positively chargeable fiber 41 to be positively charged (first bristle-like body, one positively chargeable fiber to be positively charged) and one negatively chargeable fiber 42 to be negatively charged (second bristle-like body, one negatively chargeable fiber to be negatively charged).

As shown in FIG. 7, the brush bristles 40 are so planted that the positively chargeable fibers 41 and the negatively chargeable fibers 42 are alternately arranged one by one in the front-back direction (predetermined first direction) and the lateral direction (second direction different from the first direction). The positively chargeable fibers 41 and the negatively chargeable fibers 42 are so arranged that the side peripheral surfaces and tips thereof touch each other. Further, the tips of the brush bristles 40 are faced toward the bearing surface 31*a* when the brush 33 is in the closed posture (FIG. 3). The brush bristles 40 are charged by the sliding contact of the tips thereof and the bearing surface 31*a* of the intermediate transfer belt 31 when rubbing the residual toner.

Figure 18:
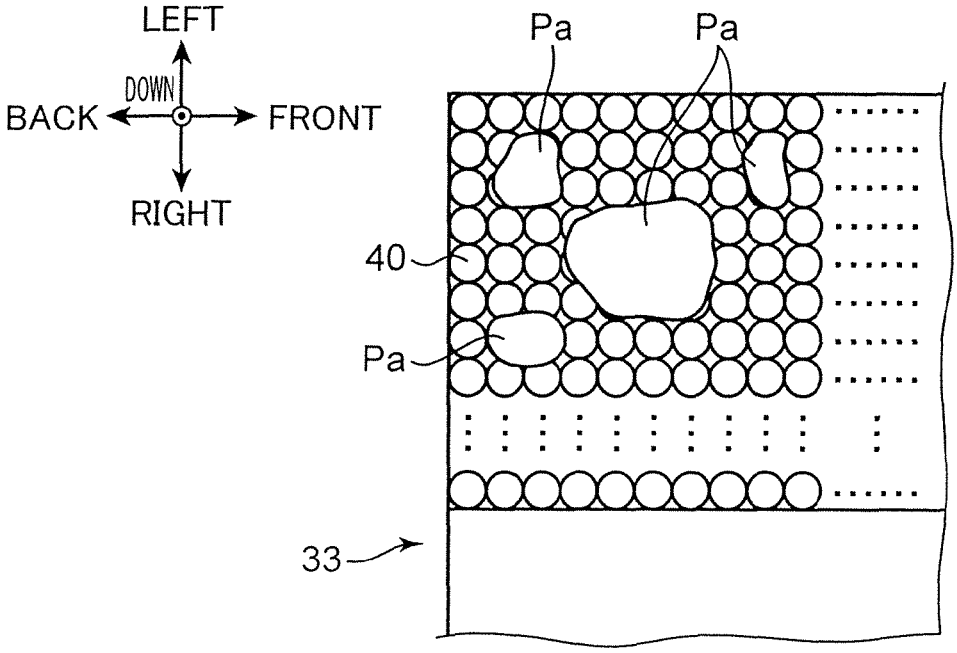
FIG. 18 is a diagram showing the brush bristles in a state where paper powder adheres to the tips.

Here, as described above, paper powder containing negatively charged foreign substances (e.g. talc), positively charged foreign substances (e.g. calcium carbonate) and the like may remain on the intermediate transfer belt 31 in addition to the residual toner. If such paper powder adheres to the bar brush 33 (see FIG. 18), a frictional charging effect of the bar brush 33 for the residual toner is reduced. As a result, the residual toner not sufficiently charged is unlikely to be attracted to and removed by the fur brush 321 of the cleaning unit 32 and remains on the intermediate transfer belt 31 to cause a cleaning failure. Further, if the paper powder adhering to the bar brush 33 is hardened, they scrape the belt surface to reduce secondary transferability.

However, in this embodiment, the positively chargeable fibers 41 constituting the brush bristles 40 repel the positively charged foreign substances (e.g. calcium carbonate) and the negatively chargeable fibers 42 repel negatively charged foreign substances (e.g. talc). Thus, even if paper powder containing both positively charged foreign substances and negatively charged foreign substances remains on the intermediate transfer belt 31, this paper powder is unlikely to adhere to the brush bristles 40. As a result, the frictional charging effect of the bar brush 33 for the residual toner is unlikely to be reduced and the satisfactorily charged residual toner is satisfactorily attracted to and removed by the fur brush 321 of the cleaning unit 32.

The material of the positively chargeable fibers 41 is not particularly limited and any material that is positively charged when rubbing the residual toner may be used. Examples of such a material may include glass fiber, mica, wool, nylon, silk, rayon, cotton and flax. Further, the material of the negatively chargeable fibers 42 is not particularly limited and any material that is negatively charged when rubbing the residual toner may be used. Examples of such a material may include polytetrafluoroethylene (PTFE), vinyl chloride, acrylic fiber, polyester, rubber, gold, copper, iron, aluminum, ebonite and paper. In this embodiment, nylon, which is an insulating material, is used as the positively chargeable fibers 41 and polyester, which is an insulating material, is used as the negatively chargeable fibers 42. Note that the above materials may be singly used or two or more kinds thereof may be used.

Figure 8:
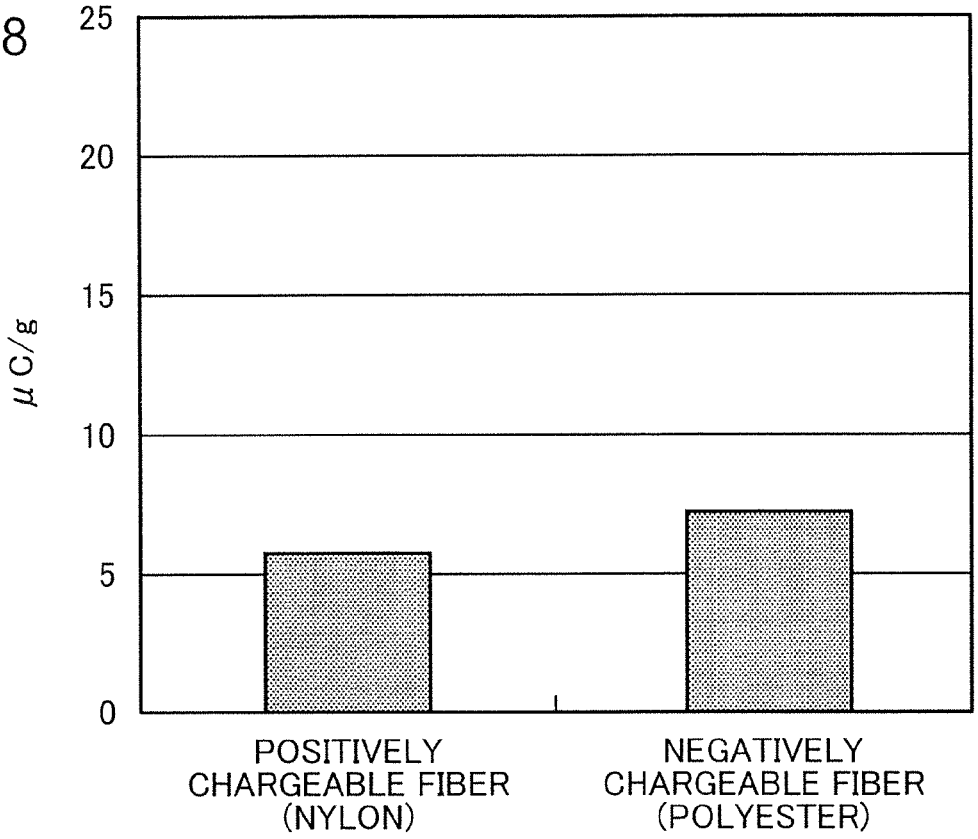
FIG. 8 is a graph showing a charging property of conductive chargeable fibers.
Figure 9:
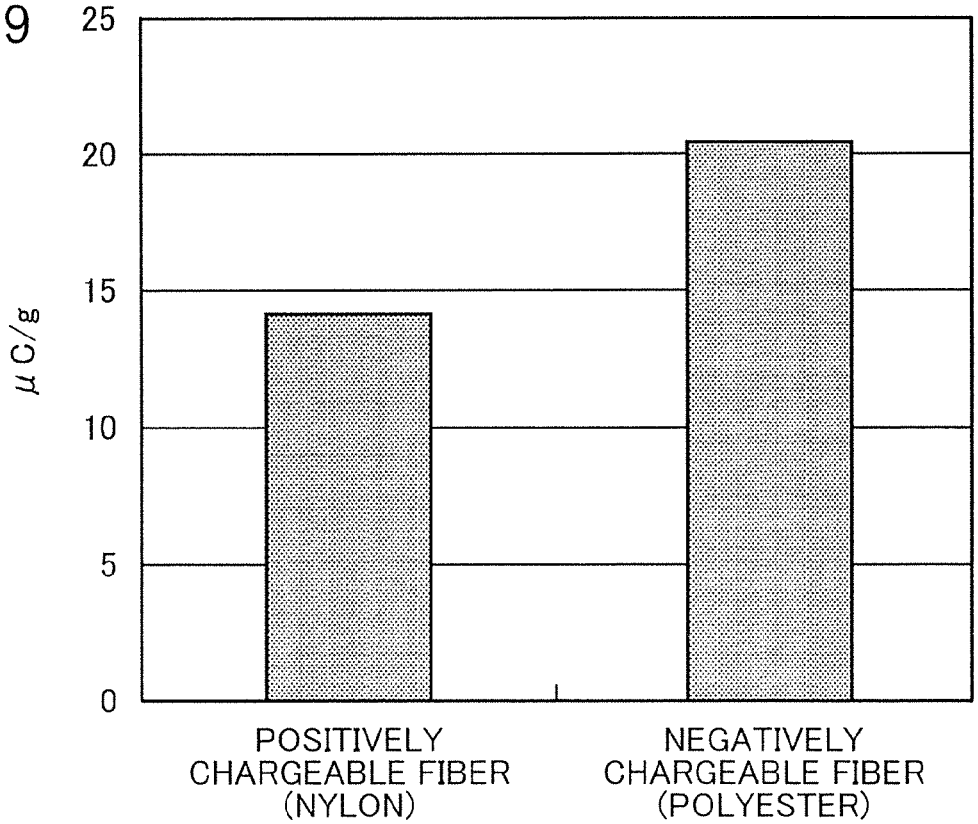
FIG. 9 is a graph showing a charging property of insulating chargeable fibers.

Further, these materials may be provided with conductivity by being appropriately mixed with a conducive filler or the like or may be insulating. FIG. 8 is a graph showing a charging property of conductive chargeable fibers and FIG. 9 is a graph showing a charging property of insulating chargeable fibers. In FIGS. 8 and 9, a vertical axis represents a charge amount (unit μC) and nylon and polyester are respectively illustrated as positively chargeable fibers and negatively chargeable fibers. Carbon is mixed as a conductive filler with the materials shown in FIG. 8 out of these materials. As can be understood from the comparison of FIGS. 8 and 9, the chargeable fibers made of the insulating material (see FIG. 9) exhibit a better charging property than the chargeable fibers made of the conductive fibers (see FIG. 8). Thus, the frictional charging effect for the residual toner is unlikely to be impaired by using the insulating material as the chargeable fibers.

Referring back to FIG. 6, the positively chargeable fibers 41 and the negatively chargeable fibers 42 constituting the brush bristles 40 are aligned to have substantially the same length. This makes the tips of the brush bristles 40 uniformly held in contact with the bearing surface 31*a* and easily chargeable and makes it difficult for paper powder to adhere to the tips of the brush bristles 40 since there is no step when the bar brush 33 is set in the closed posture (see FIG. 3).

Figure 10:
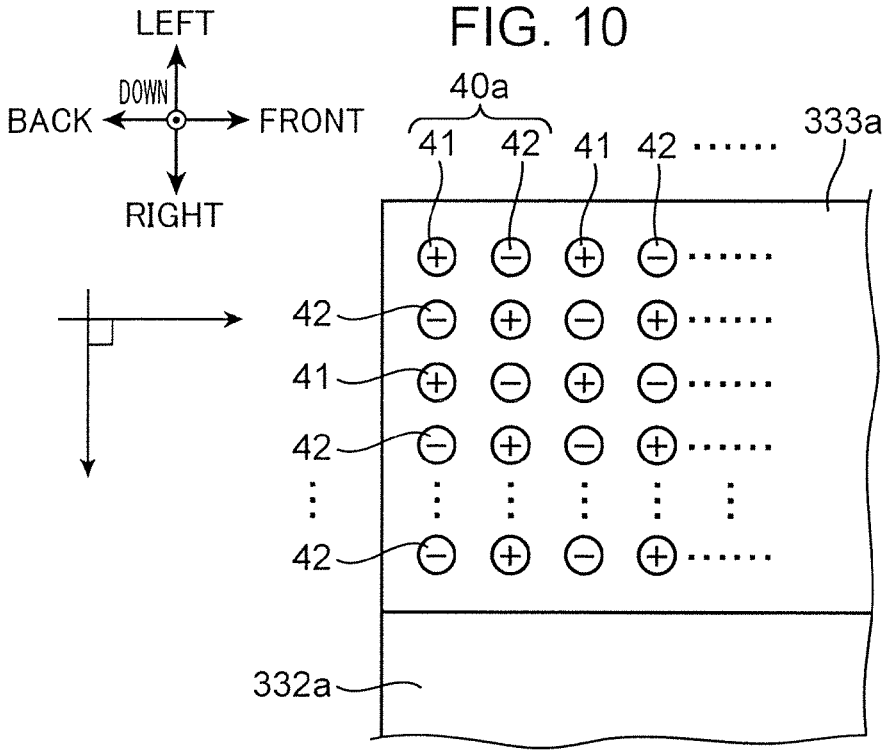
FIG. 10 is a diagram showing another example of the arrangement of the brush bristles.

In this embodiment, a density (planting density) of the brush bristles 40 is not particularly limited and can be, for example, set at 60 to 200 KF/inch2. At that time, the respective brush bristles 40 may be so arranged on the base sheet 333*a* that the side peripheral surfaces and tips thereof touch each other (see FIG. 7) or do not touch each other as shown in FIG. 10. FIG. 10 is a diagram showing another example of the arrangement of brush bristles. In FIG. 10, positively chargeable fibers 41 and negatively chargeable fibers 42 constituting brush bristles 40*a* are so planted on the base sheet 333*a* as not to touch each other in the front-back direction and the lateral direction. Out of these arrangements, in the case of the arrangement in which the positively chargeable fibers 41 and the negatively chargeable fibers 42 are arranged to touch each other (see FIG. 7), repulsive forces are likely to act on paper powder containing foreign substances. Further, no clearances are formed between the chargeable fibers. As a result, the paper powder is more unlikely to adhere to the bar brush 33.

Further, the positively chargeable fibers 41 and the negatively chargeable fibers 42 of the brush bristles 40 of this embodiment have only to be alternately arranged at least in one direction, and the arrangement in the other direction is not particularly limited. Specifically, the positively chargeable fibers 41 and the negatively chargeable fibers 42 may be alternately arranged both in the front-back direction and the lateral direction of the base sheet 333*a* (see FIG. 7 or 10) or may be alternately arranged only in either one direction. In this embodiment, the front-back direction is a width direction of the intermediate transfer belt 31. Thus, instead of a matrix arrangement of the fibers 41, 42, the positively chargeable fibers 41 and the negatively chargeable fibers 42 may be alternately arranged only in one row in the front-back direction.

Figure 11:
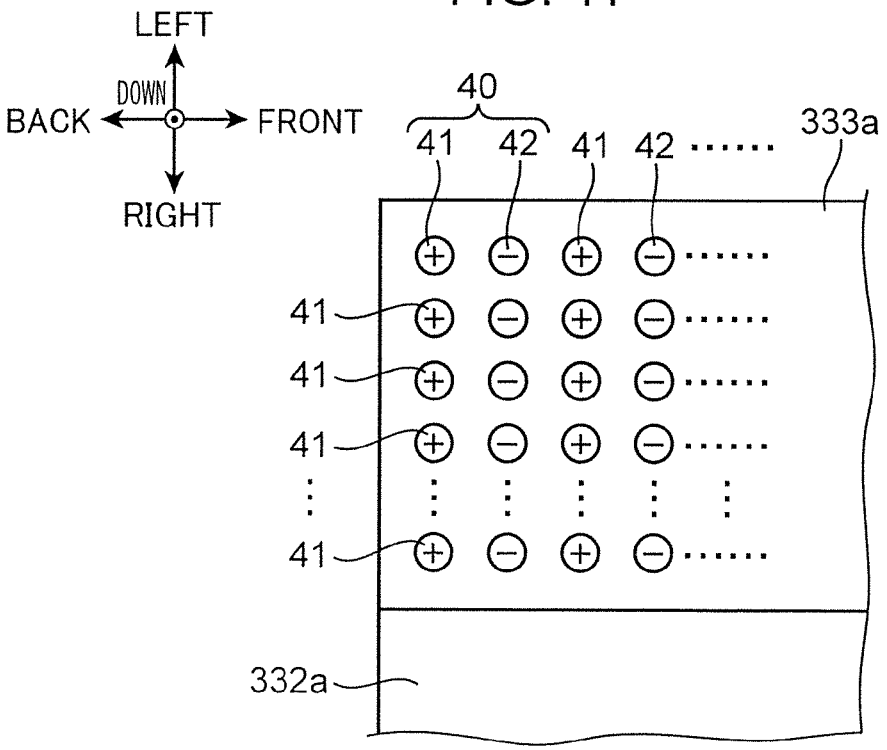
FIG. 11 is a diagram showing yet another example of the arrangement of the brush bristles.

FIG. 11 is a diagram showing another example of the arrangement of the brush bristles 40. As shown in FIG. 11, the positively chargeable fibers 41 and the negatively chargeable fibers 42 are alternately arranged in the front-back direction of the base sheet 333*a* and the chargeable fibers having the same charging property (e.g. positively chargeable fibers 41) are arranged in the lateral direction. In this case, the bar brush 33 can be easily produced and production efficiency is excellent as compared with the case where the positively chargeable fibers 41 and the negatively chargeable fibers 42 are alternately arranged in two directions.

Figure 12:
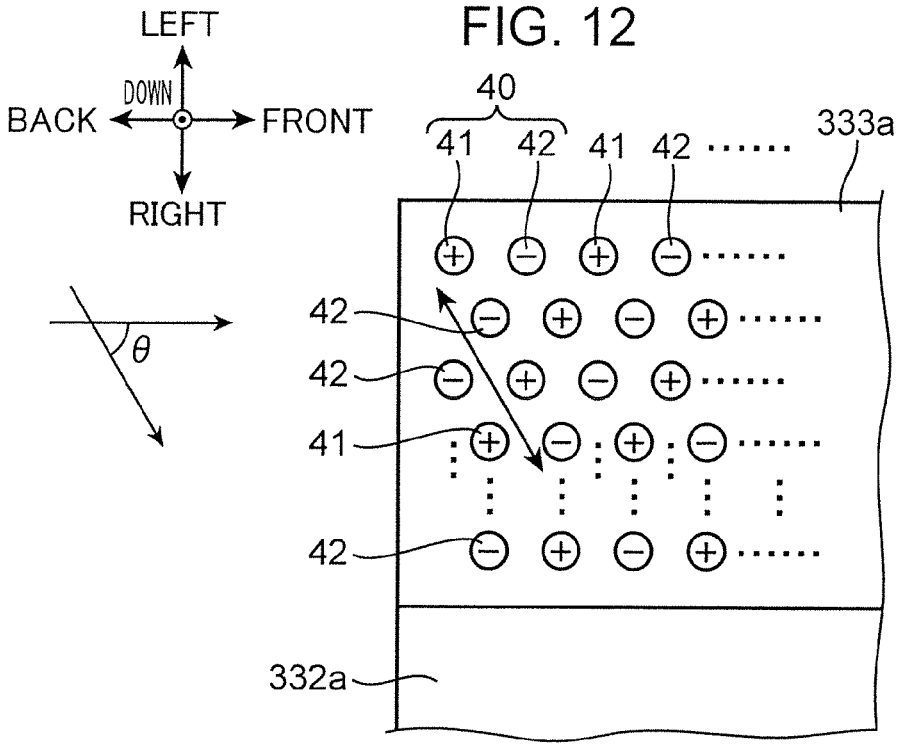
FIG. 12 is a diagram showing yet another example of the arrangement of the brush bristles.

Further, in the case of alternately arranging the brush bristles 40 in two different directions, an angle between these directions is not particularly limited. Specifically, the positively chargeable fibers 41 and the negatively chargeable fibers 42 may be alternately arranged in two orthogonal directions such as the front-back direction and the lateral direction (see FIG. 7 or 10) or may be alternately arranged in two directions forming a predetermined angle θ. FIG. 12 is a diagram showing another example of the arrangement of the brush bristles 40. As shown in FIG. 12, the positively chargeable fibers 41 and the negatively chargeable fibers 42 are alternately arranged in the front-back direction and a direction inclined by the predetermined angle θ with respect to the front-back direction. The magnitude of the angle θ is not particularly limited and may be above 0° and below 90°.

Note that in the case of alternately arranging the positively chargeable fibers 41 and the negatively chargeable fibers 42 in two orthogonal directions as shown in FIGS. 7 and 10, regular repulsive forces can act on foreign substances contained in paper powder by using the bar brush 33 including the brush bristles 40 arranged in such a manner. On the other hand, in the case of alternately arranging the positively chargeable fibers 41 and the negatively chargeable fibers 42 in the directions inclined by the predetermined angle θ with respect to each other as shown in FIG. 12, the positively chargeable fibers 41 and the negatively chargeable fibers 42 are irregularly arranged in the lateral direction. Repulsive forces can act on foreign substances contained in paper powder in a complicated manner by using the bar brush 33 including the brush bristles 40 with the irregularly arranged positively chargeable fibers 41 and negatively chargeable fibers 42. In either case, since sufficient repulsive forces act on the paper powder, the paper powder is unlikely to adhere to the bar brush 33.

Referring back to the description of the overall bar brush 33, the bar brush 33 including the above brush bristles 40 is attached to the casing 34 by fitting the opposite end parts of the cylindrical frame 331*a* into the fitting grooves 341*a*, 342*a* of the front and rear plates 341, 342 as shown in FIG. 4. Further, the tips of the brush bristles 40 are in contact with the bearing surface 31*a* of the intermediate transfer belt 31 immediately to the left of the driven roller 142 in the state where the bar brush 33 is set in the closed posture as shown in FIG. 3.

Note that, when being rotated clockwise about the cylindrical frame 331*a* in the state where the bar brush 33 is set in the closed posture, the bar brush 33 is changed to the open posture as shown in FIG. 4. In this way, the fur brush 321, the collecting roller 332 and the like in the casing 34 are exposed. In this state, a predetermined maintenance operation is performed if necessary.

The residual toner remaining on the bearing surface 31*a* of the intermediate transfer belt 31 is frictionally charged by the bar brush 33 in the closed posture. At this time, even if paper powder containing foreign substances is present on the bearing surface 31*a* of the intermediate transfer belt 31 together with the residual toner, the paper powder is unlikely to adhere to the bristles 40 of the bar brush 33. Thus, the frictionally charged residual toner and paper powder adhere to the fur brush main body 321*b* of the fur brush 321 rotating about the brush shaft 321*a* and, thereafter, transferred to the collecting roller 322 whose circumferential surface is rotating in contact with the fur brush main body 321*b* of the fur brush 321. The residual toner and paper powder adhering to the circumferential surface of this collecting roller 322 are scraped off by the blade 323 and collected into the storage space S according to the rotation of the collecting roller 322.

As described above, the image forming apparatus 10 of this embodiment includes the above belt cleaning device 30. The belt cleaning device 30 includes the bar brush 33 arranged upstream of the cleaning unit 32 for removing the residual toner in the rotating direction of the intermediate transfer belt 31. The residual toner is rubbed and sufficiently frictionally charged by the bristles 40 of the bar brush 33. At that time, the positively chargeable fibers 41 and the negatively chargeable fibers 42 of the bristles 40 are alternately arranged at least in one predetermined direction.

Thus, even if paper powder contains both negatively charged foreign substances (e.g. talc) and positively charged foreign substances (e.g. calcium carbonate), such paper powder is unlikely to adhere to the bar brush 33. As a result, the bar brush 33 can frictionally charge the residual toner over a long period of time. The frictionally charged residual toner is satisfactorily removed by the cleaning unit 32. Further, the belt cleaning device 30 has a smaller number of parts as compared with conventional devices including a plurality of brushes and the like. As a result, the belt cleaning device 30 is low in cost and can realize space saving. Further, since the image forming apparatus 10 of this embodiment including such a belt cleaning device 30 can keep the intermediate transfer belt 31 clean, it can form good images over a long period of time. Further, the image forming apparatus 10 is low in cost and can realize space saving since including the above belt cleaning device 30 having a small number of parts.

Second Embodiment

Next, another embodiment of an image forming apparatus including a belt cleaning device of the present disclosure is described in detail based on the drawings. The image forming apparatus of this embodiment is similar to the image forming apparatus 10 of the first embodiment except that the configuration of a toner rubber portion (bar brush) is different from that of the toner rubbing portion (bar brush 33) described in detail in the first embodiment. Accordingly, the configuration of the toner rubber portion (bar brush) is described below.

Figure 13:
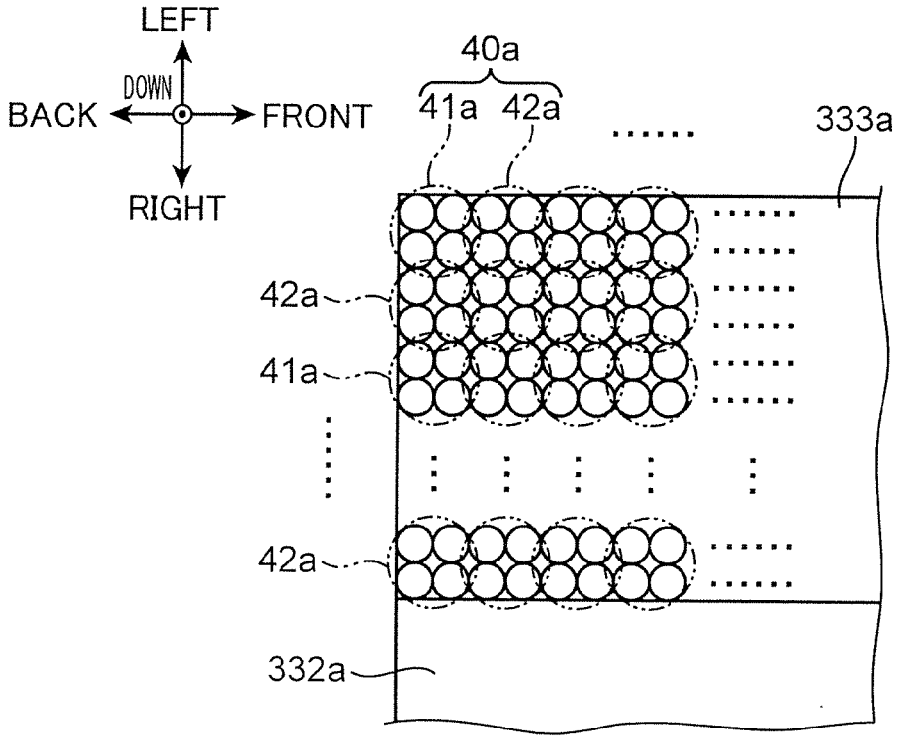
FIG. 13 is a diagram showing the arrangement of brush bristles.
Figure 14:
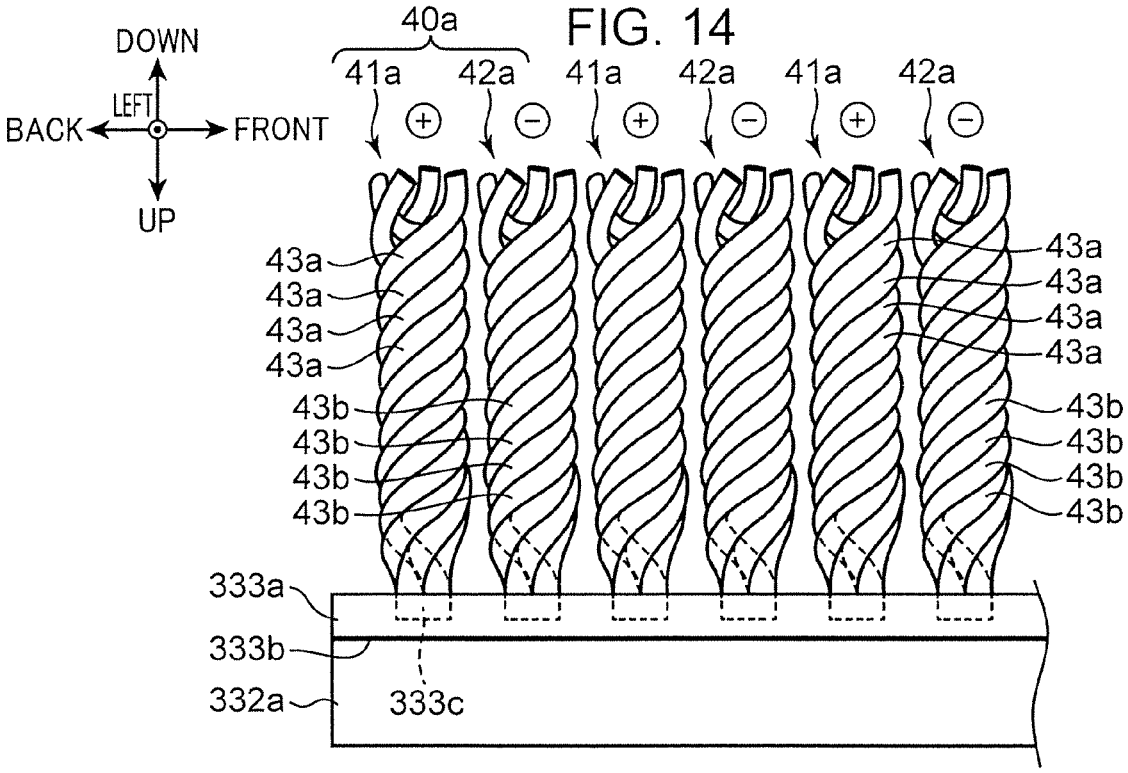
FIG. 14 is a diagram showing chargeable fiber bundles according to one embodiment of the present disclosure when viewed from left.

FIGS. 13 and 14 are diagrams showing the arrangement of bristles 40*a* planted on a base sheet 333*a*. FIG. 13 is the diagram showing the tips of the bristles 40*a* when viewed from below, and FIG. 14 is the diagram showing the bristles 40*a* when viewed from left. In this embodiment, the bristle 40*a* includes a positively chargeable fiber bundle 41*a* composed of a plurality of fiber bodies and to be positively charged (first bristle-like body; positively chargeable fiber bundle composed of a plurality of fiber bodies and to be positively charged) and a negatively chargeable fiber bundle 42*a* composed of a plurality of fiber bodies and to be negatively charged (second bristle-like body; negatively chargeable fiber bundle composed of a plurality of fiber bodies and to be negatively charged). Note that, in FIG. 13, chain double-dashed lines are drawn to distinguish the positively chargeable fiber bundles 41*a* or the negatively chargeable fiber bundles 42*a*.

The positively chargeable fiber bundles 41*a* and the negatively chargeable fiber bundles 42*a* are alternately arranged in a front-back direction (predetermined first direction) and a lateral direction (second direction different from the first direction). The tips of the bristles 40*a* arranged in this way are faced toward the bearing surface 31*a* in a state where a bar brush 33 (toner rubbing portion) is set in a closed posture (see FIG. 3). The brush bristles 40*a* are charged by the sliding contact of the tips thereof and the bearing surface 31*a* when rubbing the residual toner. The respective fiber bodies constituting the positively chargeable fiber bundles 41*a* and the negatively chargeable fiber bundles 42*a* are planted in planting holes 333*c* provided on the base sheet 333*a* in a twisted state. In this embodiment, one chargeable fiber bundle is planted in one planting hole 333*c*.

The positively chargeable fiber bundle 41*a* is composed of a plurality of chargeable fibers which are charged when rubbing residual toner. Further, the positively chargeable fiber bundle 41*a* is formed by twisting the plurality of fiber bodies. Thus, the individual fiber bodies of the positively chargeable fiber bundle 41*a* are unlikely to come off and withstand long-term use. Note that the positively chargeable fiber bundle 41*a* has only to possess a property of being positively charged as the whole fiber bundle and charging properties of the individual fiber bodies constituting the fiber bundle are not particularly limited. Specifically, out of the plurality of fiber bodies constituting the positively chargeable fiber bundle 41*a*, all the fiber bodies may be positively chargeable fibers or some fiber bodies may be positively chargeable fibers and the remaining fiber bodies may be negatively chargeable fibers or antistatic fibers. The number of the fiber bodies constituting the positively chargeable fiber bundle 41*a* is not particularly limited and has only to be two or more.

Similarly to the positively chargeable fiber bundle 41*a*, the negatively chargeable fiber bundle 42*a* is composed of a plurality of chargeable fibers which are charged when rubbing residual toner. Further, the negatively chargeable fiber bundle 42*a* is formed by twisting the plurality of fiber bodies. Thus, the individual fiber bodies of the negatively chargeable fiber bundle 42*a* are unlikely to come off and withstand long-term use. Note that the negatively chargeable fiber bundle 42*a* has only to possess a property of being negatively charged as the whole fiber bundle and charging properties of the individual fiber bodies constituting the fiber bundle are not particularly limited. Specifically, out of the plurality of fiber bodies constituting the negatively chargeable fiber bundle 42*a*, all the fiber bodies may be negatively chargeable fibers or some fiber bodies may be negatively chargeable fibers and the remaining fiber bodies may be negatively chargeable fibers or antistatic fibers. The number of the fiber bodies constituting the negatively chargeable fiber bundle 42*a* is not particularly limited and has only to be two or more.

The positively chargeable fiber bundles 41*a* can repel similarly positively charged foreign substances (e.g. calcium carbonate) and prevent the adhesion of paper powder containing the foreign substances to the bar brush. On the other hand, the negatively chargeable fiber bundles 42*a* can repel similarly negatively charged foreign substances (e.g. talc) and prevent the adhesion of paper powder containing the foreign substances to the bar brush. As a result, aggregated paper powder is particularly unlikely to adhere to the bar brush. Further, since each of these chargeable fiber bundles is composed of a plurality of fibers and planted in one planting hole 333*c*, a plurality of fiber bodies can be planted on the base sheet 333*a* by one planting operation during production, wherefore production efficiency is improved.

Although the embodiments of the present disclosure have been described above, the present disclosure is not limited to this. For example, the following embodiments can be adopted.

(1) In the above embodiments, the tandem image forming apparatus is illustrated in which the plurality of image forming units corresponding to the plurality of toner colors are arranged. Instead of this, the image forming apparatus may be an image forming apparatus adopting another method such as a four-cycle method for performing printing for each color a plurality of times using one photoconductive system.

Figure 15:
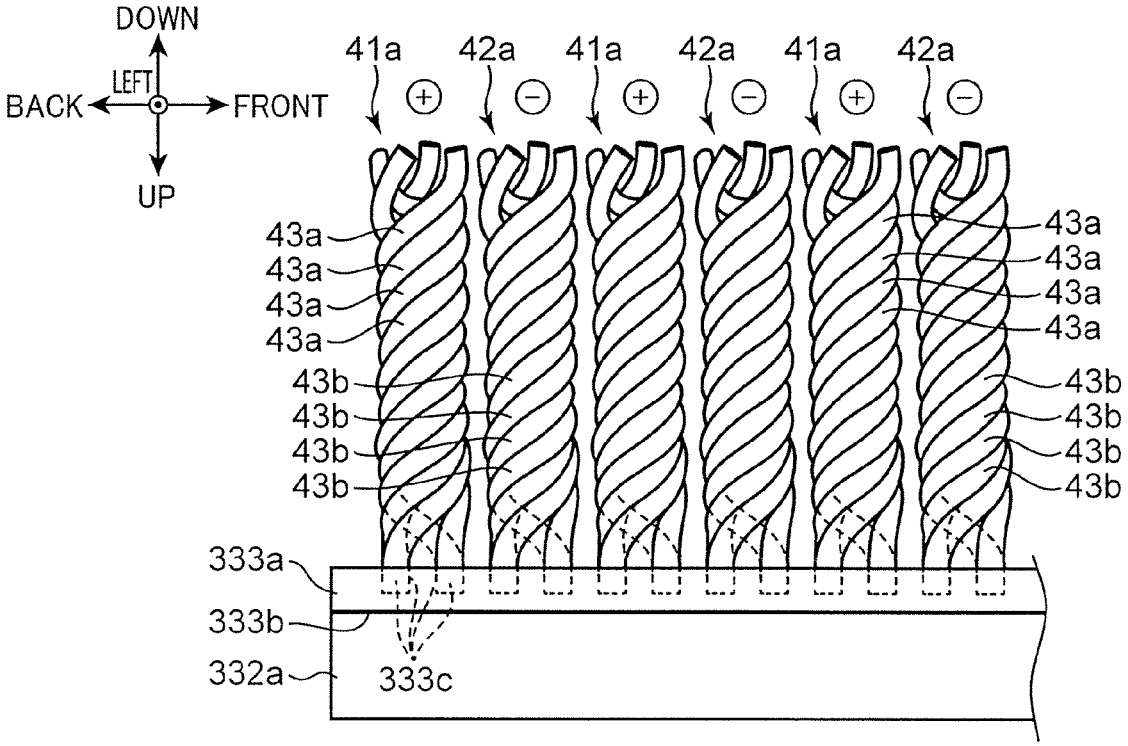
FIG. 15 is a diagram showing another example of the chargeable fiber bundles.

(2) In the above embodiment (second embodiment), a case is illustrated where one chargeable fiber bundle is planted in one planting hole. Instead of this, the brush bristles may be such that one chargeable fiber is planted in one planting hole and adjacent chargeable fibers are twisted into a bundle from the base sheet side toward a tip side to form a chargeable fiber bundle. FIG. 15 is a diagram showing another example of chargeable fiber bundles. As shown in FIG. 15, brush bristles of this different example are such that chargeable fibers (positively chargeable fibers 43*a* or negatively chargeable fibers 43*b*) are separately planted in different planting holes 333*c*. The chargeable fiber is twisted with adjacent chargeable fibers into a bundle from the side of the base sheet 333*a* toward a tip side (positively chargeable fiber bundle 41*a* or negatively chargeable fiber bundle 42*a*). Note that the number of the chargeable fibers twisted together in forming the chargeable fiber bundle is not particularly limited and has only to be two or more.

Figure 16:
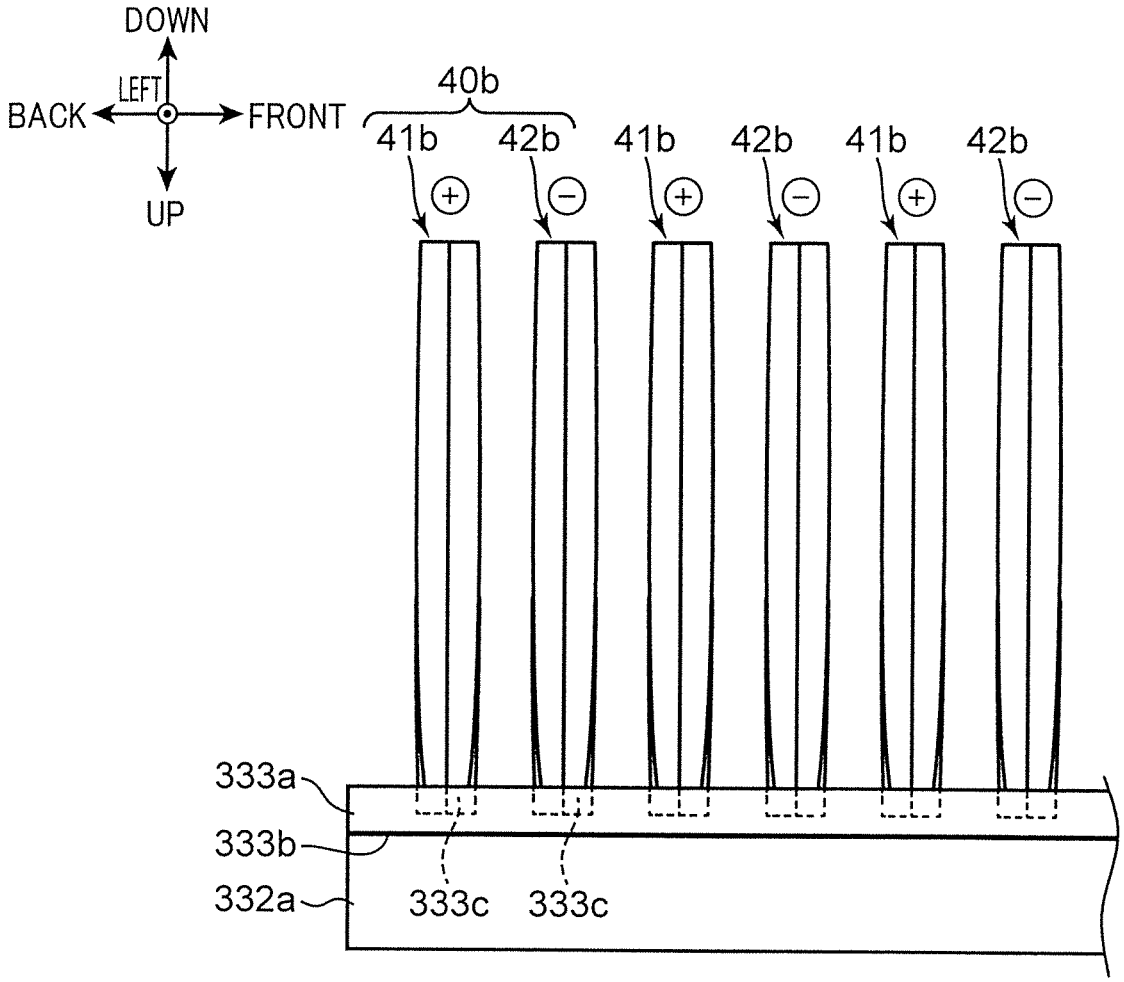
FIG. 16 is a diagram showing brush bristles of another example when viewed from left.
Figure 17:
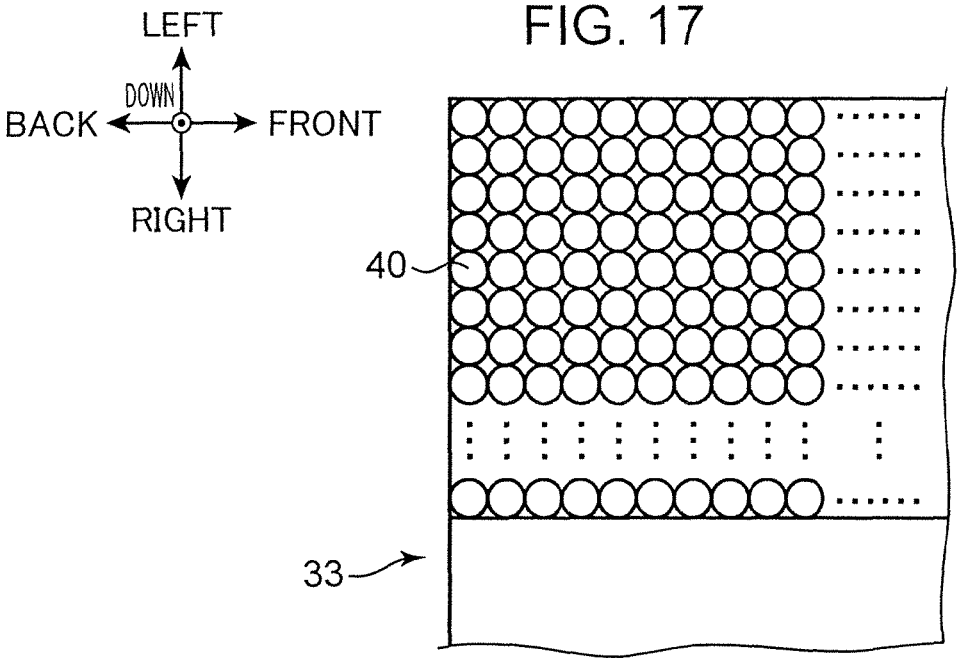
FIG. 17 is a diagram showing brush bristles in a clean state where no foreign substance adheres to tips.

Besides, it is not essential to form the brush bristles by twisting the chargeable fibers. A plurality of chargeable fibers may be planted in each planting hole and the chargeable fibers planted in the same planting hole may be treated as one chargeable fiber bundle. FIG. 16 is a diagram showing brush bristles of another example of the second embodiment when viewed from left. As shown in FIG. 16, a positively chargeable fiber bundle 41*b* and a negatively chargeable fiber bundle 42*b* constituting a brush bristle 40*b* are respectively planted in different planting holes 333*c*. The chargeable fiber bundle (e.g. positively chargeable fiber bundle 41*b*) planted in the same planting hole 333*c* is not twisted.

Further, the brush bristle may be formed by plating chargeable fibers one by one in a plurality of planting holes, twisting several chargeable fibers into bundles and then further twisting the obtained fiber bundles into one chargeable fiber bundle.

(3) In the above embodiments, the bar-shaped brush (bar brush) is illustrated as an example of the toner rubbing portion. The toner rubbing portion used in the image forming apparatus of the present disclosure has only to include the above brush bristles for charging the residual toner by rubbing it and the shape thereof is not limited to the bar shape.

As described above, according to the present disclosure, it is possible to provide a belt cleaning device capable of removing foreign substances without reducing a frictional charging effect for residual toner and realizing low cost and space saving and an image forming apparatus provided with such a belt cleaning device.

The invention claimed is:

1. A belt cleaning device for an endless belt which has a bearing surface for bearing a toner image and is rotated in a predetermined direction, comprising:

a cleaning unit which is arranged to face the bearing surface and removes residual toner remaining on the bearing surface; and a toner rubbing portion which is arranged to face the bearing surface at a side upstream of the cleaning unit in the rotating direction of the belt and charges the residual toner by rubbing the residual toner;

wherein:

the toner rubbing portion includes brush bristles whose tips are faced toward the bearing surface and which are charged when rubbing the residual toner;

the brush bristles include first bristle-like bodies to be positively charged and second bristle-like bodies to be negatively charged; and the first and second bristle-like bodies are alternately arranged in a predetermined first direction.

2. A belt cleaning device according to claim 1, wherein the first and second bristle-like bodies are arranged to touch each other.

3. A belt cleaning device according to claim 1, wherein:

the first bristle-like bodies are made of one positively chargeable fiber to be positively charged; and the second bristle-like bodies are made of one negatively chargeable fiber to be negatively charged.

4. A belt cleaning device according to claim 1, wherein:

the first bristle-like bodies are made of a positively chargeable fiber bundle composed of a plurality of fiber bodies and to be positively charged;

the second bristle-like bodies are made of a negatively chargeable fiber bundle composed of a plurality of fiber bodies and to be negatively charged.

5. A belt cleaning device according to claim 4, wherein:

the positively chargeable fiber bundle is formed by twisting the plurality of fiber bodies; and the negatively chargeable fiber bundle is formed by twisting the plurality of fiber bodies.

6. A belt cleaning device according to claim 1, wherein:

the first and second bristle-like bodies are alternately arranged also in a second direction different from the first direction.

7. A belt cleaning device according to claim 1, wherein:

the first and second bristle-like bodies are respectively made of an insulating material.

8. A belt cleaning device according to claim 1, wherein:

the belt is an intermediate transfer belt, to which toner images are transferred from a plurality of image forming units, in a tandem image forming apparatus in which the plurality of image forming units corresponding to a plurality of toner colors are arranged.

9. An image forming apparatus, comprising:

a plurality of image forming units each of which forms a toner image of a different color;

an endless intermediate transfer belt which has a bearing surface for bearing the toner images, to which the toner images are respectively transferred from the plurality of image forming units and which is rotated in a predetermined direction;

a cleaning unit which is arranged to face the bearing surface and removes residual toner remaining on the bearing surface; and a toner rubbing portion which is arranged to face the bearing surface at a side upstream of the cleaning unit in the rotating direction of the belt and charges the residual toner by rubbing the residual toner;

wherein:

the toner rubbing portion includes brush bristles whose tips are faced toward the bearing surface and which are charged when rubbing the residual toner;

the brush bristles include first bristle-like bodies to be positively charged and second bristle-like bodies to be negatively charged; and the first and second bristle-like bodies are alternately arranged in a predetermined first direction.

* * * * *